US009994373B2

(12) United States Patent
Rothweiler et al.

(10) Patent No.: US 9,994,373 B2
(45) Date of Patent: Jun. 12, 2018

(54) CONTAINER WITH MOUTH AND CLOSURE WITH DISC SEAL

(75) Inventors: Peter Rothweiler, Freden (DE); Heinz-Rudolf Wiening, Alfeld/Leine (DE)

(73) Assignee: ALFELDER KUNSTSTOFFWERKE HERM. MEYER GMBH, Alfeld/Leine (DE)

( * ) Notice: Subject to any disclaimer, the term of this patent is extended or adjusted under 35 U.S.C. 154(b) by 456 days.

(21) Appl. No.: 14/005,403

(22) PCT Filed: Mar. 1, 2012

(86) PCT No.: PCT/EP2012/053541
§ 371 (c)(1),
(2), (4) Date: Nov. 25, 2013

(87) PCT Pub. No.: WO2012/126707
PCT Pub. Date: Sep. 27, 2012

(65) Prior Publication Data

US 2014/0091093 A1 Apr. 3, 2014

(30) Foreign Application Priority Data

Mar. 23, 2011 (DE) ..... 10 2011 014 886

(51) Int. Cl.

| | |
|---|---|
| ***B65D 53/00*** | (2006.01) |
| ***B65D 53/04*** | (2006.01) |
| ***B65D 51/20*** | (2006.01) |
| ***B65D 55/06*** | (2006.01) |

(52) U.S. Cl.
CPC ..... *B65D 53/04* (2013.01); *B65D 51/20* (2013.01); *B65D 55/06* (2013.01); *B65D 2251/0015* (2013.01); *B65D 2251/0093* (2013.01)

(58) Field of Classification Search
CPC ..... B65D 41/0442; B65D 41/045; B65D 41/0457; B65D 55/066; B65D 55/06
USPC ..... 206/540; 220/378
See application file for complete search history.

(56) References Cited

U.S. PATENT DOCUMENTS

| | | | | |
|---|---|---|---|---|
| 3,386,920 | A * | 6/1968 | Alburger | 252/301.19 |
| 3,675,015 | A * | 7/1972 | Geib | 250/302 |
| 3,829,690 | A * | 8/1974 | Snyder | 250/302 |
| 3,861,549 | A * | 1/1975 | Watson et al. | 215/232 |
| 4,034,609 | A * | 7/1977 | Fuller | 73/335.01 |
| 4,158,778 | A * | 6/1979 | Gard | G01N 21/88 250/461.1 |
| 4,621,193 | A * | 11/1986 | Van Hoye | B05B 11/0035 250/302 |
| 4,627,997 | A * | 12/1986 | Ide | 428/216 |
| 4,660,732 | A | 4/1987 | Moore | |

(Continued)

FOREIGN PATENT DOCUMENTS

| | | |
|---|---|---|
| DE | 10 2007 057 584 | 6/2009 |
| DE | 10 2007 058 601 | 6/2009 |

(Continued)

*Primary Examiner* — Ernesto Grano
(74) *Attorney, Agent, or Firm* — Salter & Michaelson

(57) ABSTRACT

A container has a container wall, a mouth for filling with and removing a product, in particular a free-flowing or pourable product, in the interior of the container and a closure for the mouth of the container as well as a disc seal in the closure. The disc seal is provided with pigments, which can be detected by means of a sensor.

18 Claims, 1 Drawing Sheet

(56) References Cited

U.S. PATENT DOCUMENTS 4,747,499 A * 5/1988 Gach et al. ..... 215/250
4,911,830 A * 3/1990 Bromley et al. ..... 252/301.16
4,960,216 A * 10/1990 Giles ..... 215/232
5,005,719 A * 4/1991 Phillips et al. ..... 215/230
5,018,632 A * 5/1991 Schmidt ..... 215/230
5,443,987 A * 8/1995 DeCicco et al. ..... 435/4
5,470,502 A * 11/1995 Hahn et al. ..... 252/301.35
5,712,042 A * 1/1998 Cain ..... B32B 15/04 215/347
6,025,909 A * 2/2000 Juvinall ..... G01N 21/9054 356/239.4
6,234,335 B1 * 5/2001 Gee ..... B29C 66/02 156/272.6
6,253,940 B1 * 7/2001 Graham ..... B65D 41/3423 215/252
6,659,507 B2 * 12/2003 Banahan ..... G09F 3/0292 206/807
6,903,505 B2 * 6/2005 McNulty ..... H01L 51/5036 313/503
7,178,896 B2 * 2/2007 Strecker ..... B41J 2/1603 347/20
7,394,383 B2 * 7/2008 Hager ..... B29C 45/14065 215/230
8,003,009 B2 * 8/2011 Zaelke ..... G01N 21/91 252/301.19
8,820,923 B2 * 9/2014 Harding ..... C08K 5/29 351/159.01
8,895,158 B2 * 11/2014 Trexler ..... B42D 25/29 428/424.8
9,421,575 B2 * 8/2016 Patel ..... B32B 7/02
2001/0048524 A1 * 12/2001 Sones ..... G01N 21/8806 356/239.4
2004/0075218 A1 * 4/2004 Heinzen ..... 277/321
2006/0000545 A1 * 1/2006 Nageli ..... B32B 27/32 156/272.2
2006/0003122 A1 * 1/2006 Nageli ..... B32B 7/12 428/35.7
2006/0231519 A1 10/2006 Py et al.
2007/0298273 A1 * 12/2007 Thies ..... B32B 27/32 428/516
2008/0233424 A1 * 9/2008 Thorstensen-Woll .... B32B 7/06 428/621
2011/0278299 A1 * 11/2011 Schueller et al. ..... 220/288
2011/0311416 A1 * 12/2011 Palmer ..... B01L 3/5453 422/547
2012/0193267 A1 * 8/2012 Balthes ..... 206/540

FOREIGN PATENT DOCUMENTS

DE 11 2007 003 170 10/2009
FR 2 941 713 8/2010
WO 94/29831 12/1994
WO 2010/086171 8/2010

* cited by examiner

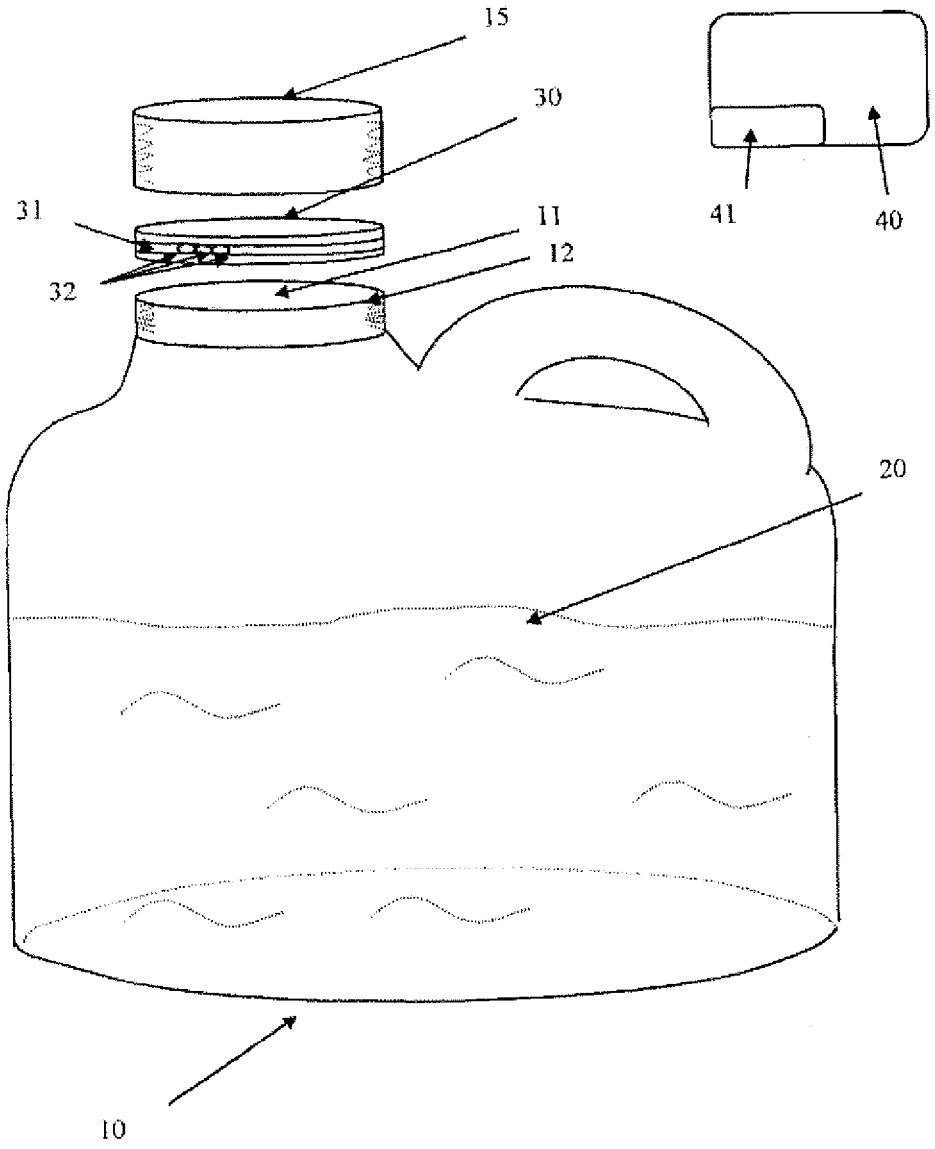
15
30
31
11
12
32
41
40
20
10

CONTAINER WITH MOUTH AND CLOSURE WITH DISC SEAL

TECHNICAL FIELD

The invention relates to a container having a container wall, a mouth for filling and removing a filling material, in particular a free-flowing or pourable product, in the interior of the container, a closure for the mouth of the container, and a disc seal in the closure.

BACKGROUND OF THE INVENTION

Containers usually possess a container wall, which surrounds an interior space. A mouth serves for filling the interior of containers, for example, with liquids or powder-form substances or otherwise free-flowing materials. These may also involve pourable container contents, e.g., pills in the case of pharmaceuticals or even granulates, e.g., in the case of fertilizers in larger containers. The mouth of the container can be closed with a closure, for example, with a screw cap. After unscrewing the cap, the container contents can be removed via the mouth by a consumer.

A container for fat-containing liquid products having a container closure is described in US 2006/0231519 A1. A material that fuses upon applying infrared radiation and closes the container is contained in the stopper.

In order to prevent the contents from unintentionally leaking from containers or to prevent oxygen or other gaseous components from the environment to penetrate into the interior of the container in an undesired manner, disc seals are additionally disposed in container closures. These disc seals can be sealed onto or glued onto or otherwise fastened onto the mouth of the container, for example, by means of induction sealing or also in another way, and thus seal this mouth. In this case, the disc seal still also needs to be broken or removed in addition to unscrewing the screw cap or otherwise opening the closure, or a mechanism which carries out the removal of the disc seal from the mouth of the container must be provided in the container closure.

An important field of application for such containers, among others, is agrochemicals, as well as other product contents that lie in high-priced or security-relevant fields. Such product contents are very costly in certain circumstances. In this case, containers with a content of several liters may also be involved. Examples are, e.g., concentrated agrochemicals that are mixed with other fluids, for example, water or the like, after they are removed from the container and prior to their utilization.

In addition to agrochemicals, motor oils or other high-priced fluids or pourable products supplied in cans would also be a field of application. Cosmetics, liquid, powder-form or granulate-form pharmaceutical products, or also instant products in the food industry, e.g., soluble coffee powders or the like also come into consideration.

Since these product contents lie in the high-priced field, it is very lucrative to illegally fill a similarly appearing and also similarly smelling, but non-functioning or even highly diluted "genuine" fluid into containers, to provide them with false or counterfeit labels and to sell them at the price or approximate price of the original containers. For the interpretation of the term "high-priced", it is also to be considered that these products are also supplied in countries, in which, for example, the price for motor oil has a considerable relevance in relation to the average income of the population, and thus multiple falsifications are made even in the case of these products.

This is harmful not only for the purchaser, since he receives a worthless or low-value content for a relatively high price, but under certain circumstances, it is also dangerous, when toxic or in any case unexpected additives will be added, or essential components, e.g., those that are relevant to security or safety, are missing. In the case of motor oil, for example, with such counterfeit products, old oil is mixed in, so that, as a consequence, material damage may also occur.

This is also very unpleasant for the provider of the original product, since, first of all, sales to customers who are interested in it will be lost, and, secondly, considerable hassle and even damage to their reputation may arise under certain circumstances, when the customer acquires a presumably genuine, but unusable product, from a third party.

Providing disc seals in the above-described form represents a protection against such measures, but only against very simple counterfeit attempts. Such a disc seal just needs to be broken by a counterfeiter when acquiring a genuine container with content, in order to remove the valuable content and to be able to replace it with a cheap counterfeit product. If the counterfeiter subsequently attempts to sell the thus-modified container, then it is possible for the purchaser to determine the absence of the original disc seal, and in this way may recognize the counterfeit attempt in a timely manner when buying it.

The situation is similar with an alternatively possible disc seal, i.e., with so-called pressure seals that are introduced without sealing on, and with which a securing ring that is to be broken when the container is first opened maintains the closure on the mouth of the container.

By means of a somewhat professional operation and with corresponding device-related equipment, however, a counterfeiter can again introduce a new, easily obtainable, familiar disc seal and/or a securing ring by means of induction sealing or adhesive after filling the container with the cheap, counterfeit product content and thus conceal his actions.

These dishonest measures with counterfeit products are rapidly increasing, since many containers can also be relatively easily imitated overall and can be manufactured, disc seals and screw caps are readily obtainable in the market, and in this way, the counterfeit products can hardly be distinguished from the genuine ones.

It has already been attempted to employ counterfeit-proof or counterfeit-resistant labels for the containers, which are protected from being imitated, in contrast, for example, with holographic or also chemical means, without anything further. The customer can then keep on hand corresponding devices with which he can be assured of having in front of him a container with a content having a genuine label, so that he no longer will frequently acquire counterfeit products.

It can even be attempted to protect the entire container against counterfeiting by an appropriate selection and/or an appropriate treatment of the container material or the finished container with corresponding means.

This simply leads to the fact, however, that the manufacturer and the supplier of counterfeit products attempt to gain possession of empty containers after they have been used. They collect the empty containers, which, e.g., are discarded by farmers or other end users or, in many countries, they build up regular redemption organizations in order to gain possession of these articles that in fact have no value for the end user.

Now, since genuine containers with genuine labels are involved, it is no longer possible to recognize counterfeits with the corresponding technical devices. It is only necessary for the counterfeiter to achieve an orderly sealing of the container, which is possible, of course, in the case of a professional counterfeiting of such high-priced products and is also carried out in practice.

Thus, the previously indicated dangers are again indicated, although the dishonest counterfeiter is forced into greater expenditure to overcome these problems.

This greater expenditure, however, is increasingly taken into account, since it is very lucrative to introduce into the original container a fluid that is extremely similar to the original fluid, smells the same, but has no function, or to introduce a highly diluted "genuine" fluid. Subsequently, the containers are screwed with counterfeit or even with used original screw closures.

The agrochemicals or other valuable product contents counterfeited in this way are introduced on the market in extraordinarily large quantities. Since at first they cannot be distinguished or can barely be distinguished from the genuine products, they are acquired at very high prices by customers interested in them, usually at prices only slightly below the prices of the original products. It can often only be established after a year or after a harvest cycle that the supposedly highly effective agrochemicals, which have been obtained at high cost, are completely or in any case largely ineffective, since they involve a counterfeit or adulterated fluid.

The problem arising in this way is very problematical not only for the customers, for example, for the farmers who may lose entire harvests in this way under certain circumstances. The reputation of the original product may also suffer and the sales of the manufacturer of the original product are also attacked, since part of these sales are made by third parties having counterfeit copies.

Therefore, a considerable interest of the end user as well as the supplier of the high-priced and very special filling materials remains unchanged: finding a measure by which this dishonest process can be eliminated or at least can be made more difficult.

SUMMARY OF THE INVENTION

The object of the invention is thus to propose a possibility for a container, with which this type of abuse is made difficult.

This object is achieved by means of the invention for a generic disc seal by providing this seal in the closure with a defined pigment, and being able to detect the existence of the defined pigment in the disc seal with one or more sensors.

In this way, for the person skilled in the art, a large portion of the problems encountered very surprisingly can be overcome.

The increasing problem namely arises, among others, that to original container can theoretically be used again, as this is also known, for example, from the field of printer cartridges for laser printers. Thus, one could and can obtain used containers that had initially been filled with original chemicals from end users, for example, from farmers after the containers have been emptied. Consequently, the same container is filled with a cheap material and sold as genuine.

Each inspection and observation of the labels or even of the entire container would appear to the farmer as correct, that the container is genuine. The product contents nevertheless would be counterfeit and authenticity checking would be meaningless.

It is precisely this possibility, however, that is prevented according to the invention.

Here, namely, use is made of the circumstance that the disc seal must be broken when the container is first opened. Either it is mechanically broken by puncturing or cutting, or when it is removed, a sealing layer, with which the disc seal is sealed onto the container mouth, is damaged. Since disc seals are worthless to the end users and have already fulfilled their purpose after the first opening of the container, unlike the container that still contains the rest of the fluid, it is practically hardly possible for counterfeiters to gain possession of used disc seals that would also still have to be in very good, reusable condition.

The case is also similar for pressure seals, i.e., disc seals that are only pressed onto the container mouth and are not solidly sealed thereon, and for which a securing ring must be broken when the container is first opened.

Here also, the disc seal is never picked up by the user, since it represents no value to him in the further utilization procedure.

The collecting of original containers is thus no longer useful for the counterfeiter.

The end user of the container contents, thus, for example, the farmer, can determine by means of a sensor, which, for example, the supplier of the original product also provides to him, always after removing the screw cap, whether the disc seal still in place and lying in front of him, is or is not an original disc seal. This checking is simple and understandable to the end user and can be conducted by him also without problem during the acquisition of such costly agrochemicals or other substances of interest.

In many cases, the sensors to be employed could be too expensive for an end user. The desired effect is also achieved, however, if intermediaries or dealers are equipped with it and thus offer the security to the end user that the containers containing the high-priced products contents and purchased from this dealer are genuine.

This effect can be additionally supported if the manufacturer of the product sends inspectors for random sampling to its dealers and to other places where the corresponding containers are found, in order to conduct corresponding inspections.

For such pigments, dyes may be used that are supplied for other purposes, for example, from the company Merck KGaA in Darmstadt or Nemitz Kunststoff-Additive GmbH in Altenberge and other companies. These pigments can be prepared and modified very specially for individual customers, so that it is not possible to counterfeit the pigments at acceptable cost.

All substances that may show an appropriate reaction are understood under the term "pigments". This reaction can also consist of the fact that, upon irradiation with a corresponding frequency, such a substance does not give, or does not only give, an optical signal, but also can evoke an acoustic effect, for example by feedback or reflection or fluorescence of another radiation that then brings about an acoustic effect in a measuring instrument.

The radiation emitted by the substances also need not necessarily lie in the visible region, as long as it can be appropriately detected. Of course, visible effects of these substances can be recognized in a particularly simple way by an observer; thus, for example, a black-light lamp can be utilized in order to appropriately provide a disc seal with a bright reflection.

It is also interesting, however, if substances and sensors having radiation elements are used, which extend out from the disc seal through a closure cover to another component of the sensor and produce an effect there; for example, an identification light can indicate authenticity.

This has the great advantage that the authenticity of a container plus content can be well established when the closure has still not been unscrewed or otherwise removed, which is extraordinarily advantageous, for example, in the case of a serial investigation by an inspector with a dealer, since the thus-inspected containers with their product contents can be sold without problem with presumed authenticity without the need for individually determining this by a sampling from the transport.

Examples of such pigments are described, e.g., in DE 10 2007 058 601 A1 or also in fiber form in DE 10 2007 057 584 A1 and DE 11 2007 003 170 T5.

The pigments or dyes are constructed so that upon exposure to optical, infrared, ultraviolet, black light, or other radiation, the pigments react to specific frequencies, but do not react to other frequencies.

Comparable pigments are already utilized in practice, e.g., for security against forgery of bank notes. Authenticity can be checked at any time by suitable reaction to specific frequencies.

After the container is opened, the disc seal is broken and can also no longer be reused.

The pigments can be disposed in different layers of the disc seals that are usually composed of several layers, for example, even in temporary adhesive layers or wax layers. The substances or pigments can also be disposed in printing inks, adhesion promoters (so-called primers), in sealing layers or barrier layers. Moreover, they do not modify the technical properties of these adhesive layers or wax layers or other layers.

Also, an adhesive or a wax, or, respectively, an adhesive layer or a wax layer, with which a disc seal, e.g., is adhered to the closure temporarily or permanently, is to be viewed as part of a disc seal and the corresponding pigments and substances can also be disposed in these layers and substances. Here, this involves the bonding layer of the disc seal to the inner side of the closure.

The pigments are added as additives to the other components of the corresponding layer.

For example, it is possible to add pigments as additives, which can be stimulated only with light of a specific wavelength, for example, from the non-visible range. An emission of light is then produced in the visible spectrum by fluorescence of the corresponding pigments.

This means that the existence of the pigments is then determined only when they are exposed to specific radiation. In daylight and without the use of a corresponding sensor emitting this radiation, nothing remarkable that could draw the attention of a counterfeiter can be determined. Nevertheless, with the use of the sensor, the existence of the pigment can be detected without problem, or, however, the non-existence of the pigment and thus a counterfeiting can also be definitively determined.

For further improvement, it is provided in specific embodiments to modify the pigmentation in a certain way at specific time intervals. Thus, e.g., the proportion of specific pigments in a wax layer could be increased in steps by a few per cent at monthly or weekly intervals.

It would also be possible to change the type of pigment itself, thus, for example, to change the substance at specific time intervals, so that in each month, or in each week, the pigment reacts in a specific way to radiation having a different wavelength.

Of course, integrating a combination of the two procedures, thus a different composition of pigments in a wax layer or adhesive layer or other layer of the disc seals that is carried out at specific time intervals is also conceivable.

Basically, it would also be conceivable to change the region within a disc seal in which the pigments are added. In this case, on the one hand, it is considered to switch the layers containing the pigment, thus, for example, to provide an adhesive layer with the corresponding pigment at a certain time period and to provide a foam layer with it at another time period. Likewise, however, it is also possible to provide a specific pattern in the disc seal, for example, to provide the disc seals with the pigments during their production only in a specific width region, so that a stripe with pigment of a specific width is drawn through the disc seal. This width could then in turn also be changed at time intervals.

Organizationally, the manufacturer of the agrochemicals then would have to allocate the disc seals used when bottling a specific batch of the original product. Then, for example, depending on the date of manufacture, the disc seals could show a specific reaction when exposed to optical or other radiation.

In this way, for example, disc seals that do not match a specific batch could also be easily recognized.

In this way, it is in fact impossible for counterfeiters to do this, however, even operating at a high cost, by obtaining possession of a few original disc seals of the described type. They would then have to additionally still also determine a suitable time point for the bottling of the counterfeit product contents, but they can hardly find out this time point in advance, if it is suitably organized.

Another great advantage of the invention is that the disc seal represents a comparatively small, but nevertheless defined element of the entire complex of the container. The pigments in question are extraordinarily expensive, since very high requirements must be placed on them. The disc seal, however, is considered only a very small unit with a very small volume on the overall container, so that a comparatively small quantity of the dye is sufficient in order to introduce the effect according to the invention, compared with a configuration of the entire container wall in a manner secure against counterfeiting. It is thereby possible that a very small amount of costly pigment well suffices for giving rise to a design according to the invention. The relatively high price of the pigments then only plays a subordinate role for this small quantity.

By means of the invention, the possibility thus arises of making the authenticity of a corresponding product satisfactorily verifiable for a customer of the product. The manufacturer of the product, for example, has the possibility of easily detecting for a doubting end user that a corresponding product is a counterfeit, or can even convince him that the questioned product is actually genuine.

This detection can be made for a closed container with the disc seal still present. It is thus not necessary to subject the content of the container to an inspection or measurement.

DESCRIPTION OF THE DRAWINGS An example of embodiment of the invention will be explained in more detail below on the basis of the drawing. Herein:

FIG. 1 shows a schematic view of a container according to the invention.

DETAILED DESCRIPTION

The container 10 shown in FIG. 1 has an opening or mouth 11. The container 10 can be a bottle, a can for motor oil, a container for cosmetics, a box that can be closed in an aroma-tight manner, for example, for ground coffee, but also, in particular, a container for agrochemicals. The opening or mouth 11 is surrounded by a circumferential edge 12. The edge 12 is circular in general.

A disc seal 30 composed of several layers is found on this opening 11 after filling container 10 with a filling material 20, for example, a liquid or a powder-form, free-flowing or a granulate pourable material, and prior to opening for the first time.

The opening 11 of the container 10 with the disc seal 30 lying thereon is closed on top and laterally by a cap or closure 15. In the example of embodiment shown, the cap 15 is a screw-cap with a basic screw-cap body.

The sealing disk 30 has approximately the same diameter as the opening 11 with the edge 12 of the container 10. The disc seal 30 lies on the edge 12 of the container 10 and is solidly glued or inductively solidly sealed thereon in this embodiment.

This fastening or solid sealing is produced, of course, only after the inside space of the container 10 is filled with the filling material 20. After sealing or solidly adhering or otherwise attaching the disc seal 30 onto the edge 12 of the opening 11 of the container 10, the filling material 20 can no longer be removed wholly or partially from the inside of the container 10 without damaging the disc seal 30. The existence of an undamaged disc seal 30 is thus at the same time an indication of the fact that the filling material 20 now as previously is the original filling material of the manufacturer of the product.

The prerequisite for this, that this indication is also actually correct, is, of course, the fact that the original disc seal 30 broken due to the removal of the filling material 20 has not been replaced by another seal.

The disc seal 30 is composed of several layers, a few of which are indicated. The lowermost layer of the disc seal 30, which is adjacent to the edge 12 of the opening 11 of the container 10, is a sealing layer or adhesive layer, which assures the solid placement of the disc seal 30 on the edge 12.

Further layers are usually a foam layer, which bestows a certain elasticity of the disc seal 30, and a foil or film, which prevents any input of oxygen into the interior of the container 10 from the outside space, if such input of oxygen is not desired, which is frequently the case, in order to prevent chemical reactions with oxygen in the interior.

It is also possible, however, that still other layers and elements are provided in the disc seal 30, for example, gripping tabs projecting upward in the direction toward the screw cap 15 or protruding outwardly, in order to make possible a clean peeling or tearing away of the disc seal 30 (not shown).

In this regard, FIG. 1 shows a typical container, for example, for agrochemicals with a screw cap and a disc seal.

It is indicated in FIG. 1, however, that one (or more) additives are provided in a layer 31 of the disc seal 30, and these are in fact in the form of pigments 32. These pigments 32, thus dyes, are defined as possessing exact, pre-determined, defined physical properties, which permit a narrowly circumscribed identification.

They involve pigments of a type that are added in another way for different purposes, e.g., in bank notes, in order to be able to clearly detect their authenticity.

In particular, it is possible to detect with a sensor 40 the presence or the absence of the corresponding pigment 32 in the disc seal 30.

This sensor 40, which is indicated purely schematically in FIG. 1, can additionally be provided with a radiation element 41 that emits radiation having a specific wavelength on the disc seal 30.

The pigment 32 then reacts to the radiation having the specific wavelength of the radiation element 41, e.g., by fluorescence, and yields up a reaction, for example, by emission of light having a concrete optical wavelength, which the sensor 40 then in turn can detect.

In preferred embodiments, the sensor 40 can also be equipped so that it can more or less accurately determine the quantity of the contained pigment, so that a change in the quantity of added pigment can be utilized for defining, for example, the date of manufacture of the disc seal.

The sensor 40, however, can also be constructed so that it only contains the radiation element 41, which then, by emission of radiation, induces the pigment 32 to emit an optical light that the user can recognize.

Likewise, the sensor 40 can also be constructed, however, so that it receives a radiation signal emitted by the pigment 32 in the disc seal 30, and recognizes whether this is a signal that can be assigned to a genuine disc seal 30, and thus there is an authentic product inside the container 10.

LIST OF REFERENCE CHARACTERS

10 Container
11 Mouth or opening
12 Edge of the mouth
15 Closure or cap
20 Filling material
30 Disc seal
31 Layer of the disc seal
32 Pigment in the layer 31 of the disc seal 30
40 Sensor
41 Radiation element

What is claimed is:

1. A system for authenticating the contents of a container, said system comprising:

a container including a container wall having a mouth that defines a container opening having an opening diameter edge;

a closure for closing the mouth of the container;

a disc seal provided in the closure and disposed between the mouth of the container and the closure;

said disc seal having an outer diameter comparable to the opening diameter edge of the mouth of the container;

said disc seal including a plurality of layers that are all disposed in intimate juxtaposition and engaged within the closure;

a predetermined pigment as an additive to at least one of the plurality of juxtapositioned layers;

a sensor that is disposed separate from and external to the container and for identifying the presence and quantity of the predetermined pigment in the at least one of the plurality of layers as the predetermined pigment;

wherein the predetermined pigment is detectable and identifiable by said sensor;

wherein the predetermined pigment is stimulated with light of a predetermined wavelength, and the sensor detects the existence of the predetermined pigment by detecting the stimulated predetermined wavelength.

2. The system of claim 1 wherein the predetermined pigment is fluorescent.

3. The system of claim 1 wherein the predetermined pigment is disposed in one of an adhesive layer and a wax layer of the disc seal.

4. The system of claim 1 wherein the predetermined pigment is only disposed in specific pre-determined surface regions of the disc seal.

5. The system of claim 1 further including a radiation element and wherein the predetermined pigment reacts to pre-determined optical, infrared, or ultraviolet radiation from the radiation element having specific frequencies, but does not react to other frequencies, and the sensor detects the existence of the predetermined pigment by detecting the said specific frequencies.

6. The system of claim 1 wherein the closure is held by means of a securing ring onto the mouth of the container, and the disc seal can only be removed after damaging or breaking the securing ring.

7. The system of claim 1 wherein the predetermined pigment is added to only one of the plurality of juxtapositioned layers.

8. The system of claim 1 wherein the plurality of juxtapositioned layers includes one of a sealing layer and an adhesive layer.

9. The system of claim 1 wherein the sensor detects the absence of the corresponding pigment.

10. The system of claim 1 wherein the sensor is constructed so that it receives a radiation signal emitted by the pigment in the disc seal, and recognizes whether this is a signal that can be assigned to a genuine disc seal, and thus there is an authentic product inside the container.

11. The system of claim 1 wherein the plurality of juxtapositioned layers include a lower arranged sealing layer, an upper elastic layer and an intermediate layer into which the predetermined pigment is added.

12. The system of claim 1 wherein the at least one of the plurality of layers includes the pigment as a stripe.

13. The system of claim 12 wherein the stripe is only in a specific width region.

14. A system for authenticating the contents of a container, said system comprising:

a container including a container wall having a mouth that defines a container opening having an opening diameter edge;

a closure for closing the mouth of the container;

a disc seal provided in the closure and disposed between the mouth of the container and the closure;

said disc seal having an outer diameter comparable to the opening diameter edge of the mouth of the container;

said disc seal including a plurality of layers that are all disposed in intimate juxtaposition and engaged within the closure;

a predetermined pigment as an additive to at least one of the plurality of juxtapositioned layers;

a radiation element that is disposed separate from and external to the disc seal and that emits radiation onto the disc seal to induce the additive pigment to, in turn, emit one of an optical and acoustic recognition signal;

a sensor that is disposed separate from and external to the disc seal and for identifying the presence and quantity of the predetermined pigment in the at least one of the plurality of layers as the predetermined pigment by sensing one of an optical and acoustic recognition signal caused by the radiation element;

wherein the predetermined pigment is stimulated by the emitted radiation from the radiation element with a predetermined wavelength signal, and the sensor detects the existence of the predetermined pigment by detecting the stimulated predetermined wavelength signal generated from the emitted radiation.

15. The system of claim 14 wherein the pigment reacts to the radiation having a specific wavelength of the radiation element and yields a reaction by emission of light having a concrete optical wavelength, which the sensor then in turn detects.

16. The system of claim 14 wherein the pigment is fluorescent and the pigment is exposed to radiation by means of the radiation element, and the radiation emitted from the fluorescing pigment is observable by a user.

17. The system of claim 14 wherein the additive pigment reacts to the radiation having a predetermined wavelength of the radiation element to, in turn, have the sensor detect the predetermined wavelength.

18. The system of claim 17 wherein the additive pigment reacts to the radiation having the predetermined wavelength of the radiation element by fluorescence and yields a reaction by emission of light having a predetermined optical wavelength, which the sensor then, in turn, detects.

* * * * *